US008307571B1

(12) United States Patent
Ceylan

(10) Patent No.: US 8,307,571 B1
(45) Date of Patent: Nov. 13, 2012

(54) LADIES SHOES HAVING MULTIPLE DIFFERENT CONFIGURATIONS

(76) Inventor: Lucy Ceylan, Aventura, FL (US)

( * ) Notice: Subject to any disclaimer, the term of this patent is extended or adjusted under 35 U.S.C. 154(b) by 466 days.

(21) Appl. No.: 12/414,952

(22) Filed: Mar. 31, 2009

(51) Int. Cl.
*A43B 3/24* (2006.01)

(52) U.S. Cl. ..... 36/101

(58) Field of Classification Search ..... 36/101, 36/100, 15
See application file for complete search history.

(56) References Cited

U.S. PATENT DOCUMENTS

| | | | | |
|---|---|---|---|---|
| 2,809,449 | A | 10/1957 | Smith | |
| 3,016,630 | A * | 1/1962 | Twiggs, Jr. | 36/101 |
| 3,608,213 | A | 9/1971 | Jensen | |
| 4,103,440 | A | 8/1978 | Lawrence | |
| 4,377,042 | A * | 3/1983 | Bauer | 36/101 |
| 4,706,392 | A | 11/1987 | Yang | |
| 4,887,369 | A * | 12/1989 | Bailey et al. | 36/101 |
| 4,974,344 | A * | 12/1990 | Ching | 36/101 |
| 5,953,836 | A | 9/1999 | Watt et al. | |
| 6,389,712 | B1 | 5/2002 | Schelling | |
| 6,598,318 | B2 * | 7/2003 | Rouben | 36/15 |
| 6,813,847 | B2 * | 11/2004 | Workman | 36/15 |
| 7,168,184 | B2 * | 1/2007 | Wallin et al. | 36/15 |
| 2002/0174569 | A1 * | 11/2002 | Tsai | 36/101 |
| 2008/0271343 | A1 * | 11/2008 | Ordenes Haag | 36/101 |

* cited by examiner

*Primary Examiner* — Ted Kavanaugh
(74) *Attorney, Agent, or Firm* — Malin Haley DiMaggio Bowen & Lhota, P.A.

(57) ABSTRACT

A shoe system for providing multiple usable shoes with a reduced inventory of shoes comprising one or more top shoes that are wearable by themselves essentially having a relatively flat sole area and a separate shoe base that includes a high heeled shape end portion and a upper surface that is recessed around its periphery said top shoes each having a raised sole portion that fits snuggly into the recessed portion of the shoe base for a friction engagement and a plurality of fasteners attached to the top shoe and the shoe base for firmly attaching a pair of top shoes to the shoe base thereby greatly increasing the wardrobe potential and number of shoes available for different occasions.

4 Claims, 4 Drawing Sheets

LADIES SHOES HAVING MULTIPLE DIFFERENT CONFIGURATIONS

BACKGROUND OF THE INVENTION

1. Field of the Invention

This invention relates generally to ladies casual, business, and formal shoes including flat bottoms and high heel designs that include a shoe base that can be used with multiple different shoes, The top shoes can be worn alone or attached to a shoe base to achieve multiple different styles and color shoes for all occasions.

2. Description of Related Art

It is well known that with respect to shoes, many women in the United States desire to own multiple pairs of shoes to accommodate the wearing of shoes for multiple occasions. It is not uncommon for women to have literally closets full of different shoes for different occasions. The different shoes are embodied in different styles for casual, business, or formal occasions.

The present invention permits use of a plurality of different types of shoes such as flat bottom, low heel shoes or casuals that can be of different styles and materials. Each shoe can be worn separately or attached to a shoe base that converts the flat bottom shoe into a high heel or elevated shoe by a mechanical interlock. Using the present invention the person owning the shoes can have a large wardrobe of shoes of different colors and designs for multiple uses, formal, business, or casual without having to double the amount of formal or casual shoes being purchased and maintained.

The shoe system described herein discusses the construction of either a left shoe or a right shoe system. The invention is to be used for pairs of shoes left and right footed.

SUMMARY OF THE INVENTION

A shoe system that includes a shoe base having a high or medium heel configuration and a separate top shoe that can be worn alone as a casual, flat shoe, or slipper by itself and fasteners attached to said top shoe (which has a substantially flat sole) and said shoe base for converting the flat shoe or slipper into a formal high heel shoe using a plurality of mechanical fasteners which are also decorative.

The shoe base includes a bottom sole and a high or medium heeled configuration formed on a rigid structure to support a human foot standing on the shoe base. The shoe base includes an upper surface perimeter that provides for a flexible flange disposed around the upper surface perimeter of the shoe base. The upper surface of the shoe base also includes a recessed portion around the perimeter and central portion. When joined with a top shoe, the shoe base upper perimeter surface engages the sole or bottom surface and perimeter of the top shoe, forming an interlock.

The exterior surface of the shoe base includes two or more button type fasteners disposed strategically and spaced apart for use as fasteners to connect the shoe base to one or more top shoes. The top shoes include hook or eye fasteners.

At the back portion of the shoe base on the heel area, there may also be a mechanical "L" shaped locking member or hook that is also used as a fastener.

The shoe base can be made of conventional colors and can have a traditional high or medium heel shaped profile, configuration, or a solid base that is raised at one end to any desired heel height.

In conjunction with the shoe base (left and right), the shoe system also allows the use of multiple different colored or patterned designed top shoes that can be worn with or without the shoe base. The top shoes (left and right) are made with a substantially flat type bottom sole to be worn for all types of occasions. These top shoe can be made of different materials, colors, and completely usable by the wearer as is without the shoe base. Each of these top shoes, however, includes fasteners which in one embodiment could be elastic or non-elastic fabric or metal loops disposed around the periphery of the top shoe and that can be connected to fasteners on the shoe base such as buttons. Of course the buttons or loops can be reversed with the buttons being placed on the top shoes in a decorative manner and the loops being placed on the shoe base for fasteners.

Each of the attachable top shoes is also constructed in such a way that the top shoe sole periphery includes a raised interior portion or a flange interlock about its periphery that will not interfere with the normal walking and wearing of the top shoe alone in a conventional way but will allow the top shoe bottom to be frictionally interlocked into the separate shoe base for joining the top shoe into the shoe base to convert the shoes into more formal or dressy high heel constructions.

The present shoe system has different modes of operation. First, one or more wearable regular flat ladies shoes shaped like or traditional flat shoes are constructed. This top shoe includes a conventional shoe body, materials, and a sole much in a conventional manner. The sole construction and configuration, however, makes the top shoe especially adaptable for attachment to a separate shoe base. The top shoe sole, although the sole is flat, is configured to have a raised interior lip portion that allows the top shoe sole to fit snuggly into a recessed flange portion in the shoe base upper peripheral surface. This fit creates a friction type fit around the base perimeter where the top shoe can attach to a shoe base flange that is around the periphery of the shoe base to allow a snug mechanical fit of the top shoe into the shoe base. In addition, fasteners on the top shoe and the shoe base, such as, buttons, loops, and a mechanical interlocked "L" shaped lock hook can rigidly attach the top shoe to the shoe base so that during walking, one does not notice the top shoe and the shoe base are two separate units.

By having a plurality of wearable top shoes that can be worn for specific events with different colors and fabrics that can also be used with a shoe base in a formal setting as a high heel or raised shoe platform, essentially the wearer can double the shoes available from a single pair of shoes for casual and formal situations.

It is an object of this invention to provide an improved shoe system to extend the number of ladies shoes that can be used in multiple configurations by having a plurality of independent wearable shoes that can be attached to a lower shoe base.

It is another object of this invention to provide a shoe system that allows a conventional flat shoe to be attached to a shoe base that makes shoe into a high heel formal platform for different occasions.

In accordance with these and other objects which will become apparent hereinafter, the instant invention will now be described with particular reference to the accompanying drawings.

DETAILED DESCRIPTION

Figure 1:
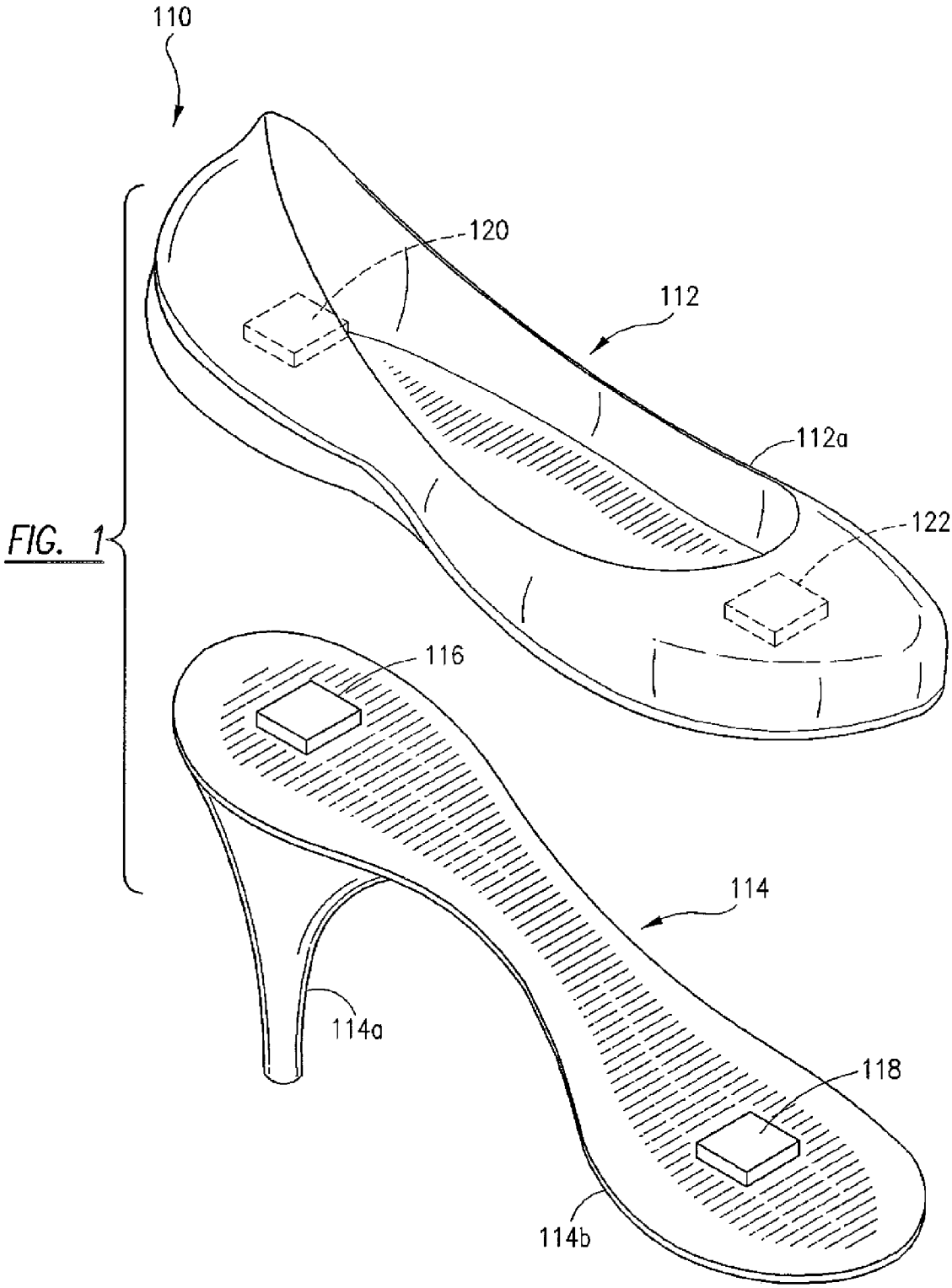
FIG. 1 shows a perspective, exploded view of a generic shoe system that embodies the concept of the invention.

Referring now to the drawings and in particular FIG. 1, generic shoe system 110 is shown comprised of an top shoe 112 that is separately wearable but can also be connected to a shoe base 114. The shoe base 114 includes a rigid outsole 114*b* with a high heel 114*a* attached at one end and a sloped, rigid insole with two generic fasteners 116, 118. The top shoe 112 includes two generic fasteners 120, 122 embedded within the outsole of the top shoe 112. These fasteners on the shoe base 114 and the top shoe 112 allow the shoe base 114 to be firmly locked to the top shoe 112 when the two are joined together to create a high heeled shoe.

The shoe system can be constructed to have a plurality of independent different colored and different styled wearable top shoes 112 each of which has the fastener 120 and 122 on the outsole that allow the top shoe 112 to be connected to a standard shoe base 114 having comparable fasteners 116 and 118 that connect respectively to fasteners 120 and 122 on the outsole of the top shoe 112*a*.

The shoe system allows for a person to maintain a large inventory of shoes for separate occasions at the same time reducing the volume required to have such interchangeable designed shoes. As an example, a top shoe 112 can be worn separately along the casual lines or perhaps some business environments while the combined top shoe 112 and shoe base 114 allows for a dressier or more formal of business attire using only the same pair of top shoes and a shoe base.

Figures 2, 3:
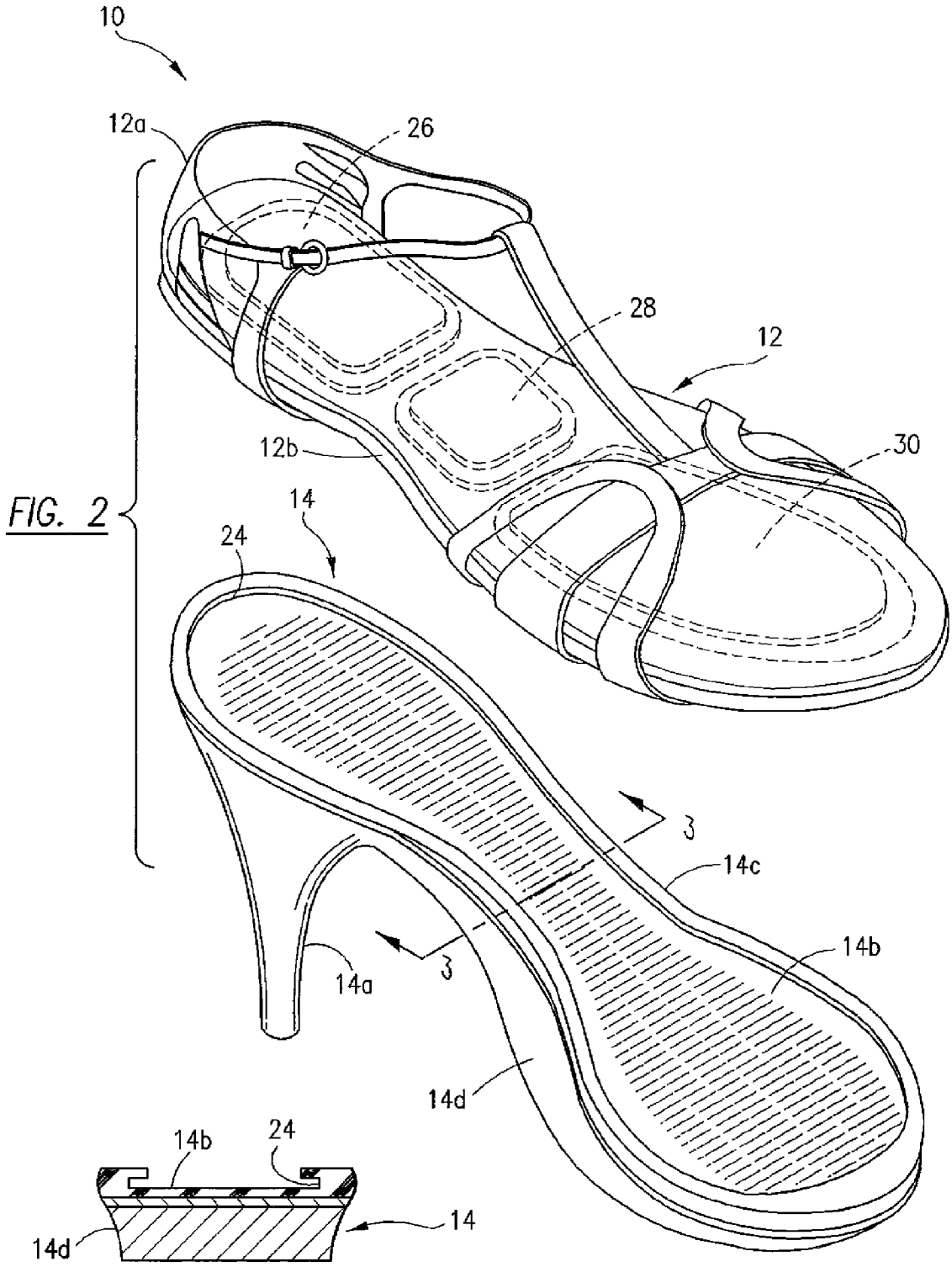
FIG. 2 shows a perspective, exploded view of a shoe system built in accordance with the invention.
FIG. 3 shows a cross-sectional view along line 3-3 of FIG. 2 of the shoe base in accordance with the present invention.

Referring now to FIG. 2, FIG. 3, FIG. 4, and FIG. 5, the shoe system 10 is shown comprised of a top shoe 12 having toe straps 12*b* and body 12*a* that is separately wearable but can also be connected to a shoe base 14. The shoe base 14 includes a high heel 14*a* attached at one end of the outsole and a sloped, rigid insole 14*b* that includes an inside recessed portion 24 around perimeter of the shoe base 14. A cross-section of bottom shoe base 14 is shown in FIG. 3 having a recess or slot 24. This rigid insole 14*b* includes peripheral slot 24 that connects to the upper shoe 12.

Figure 4:
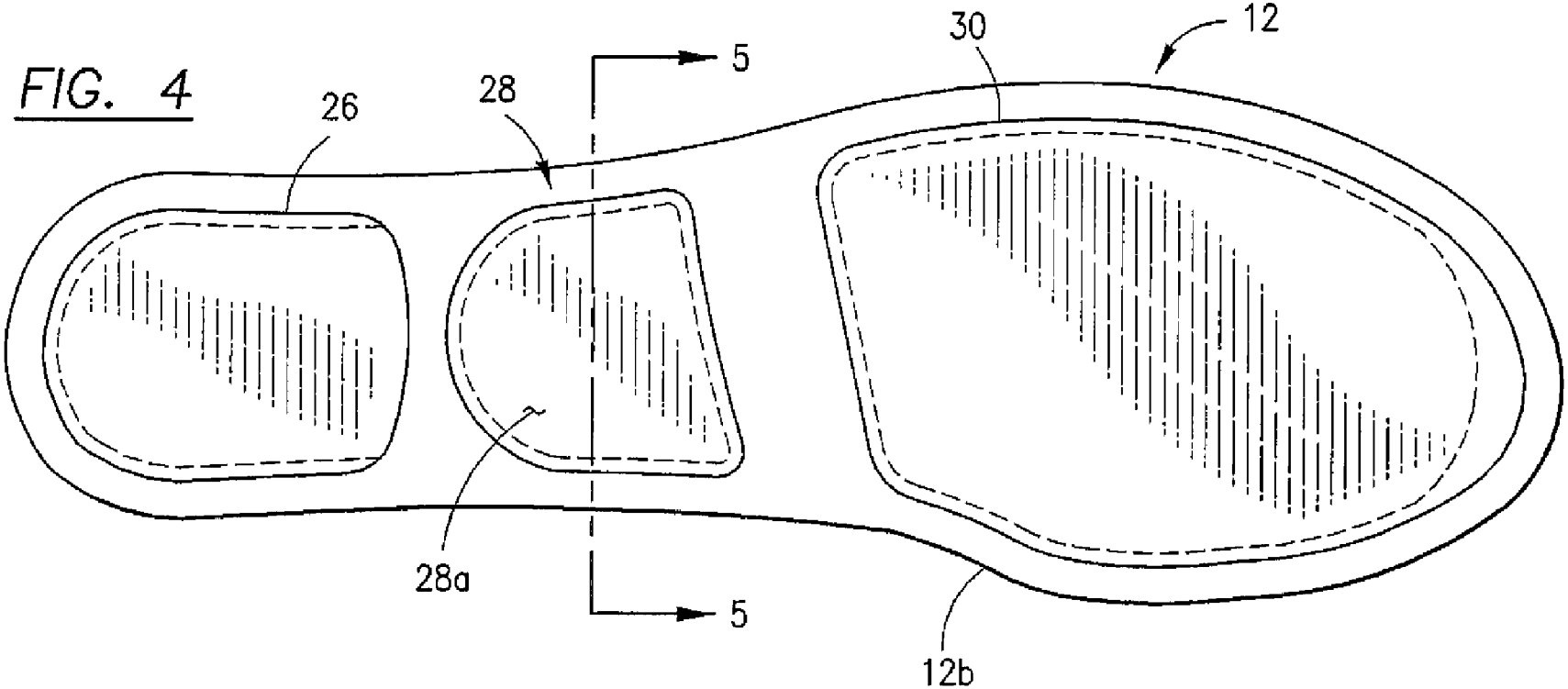
FIG. 4 shows a bottom plan view of the top shoe used with the present invention.
Figure 5:
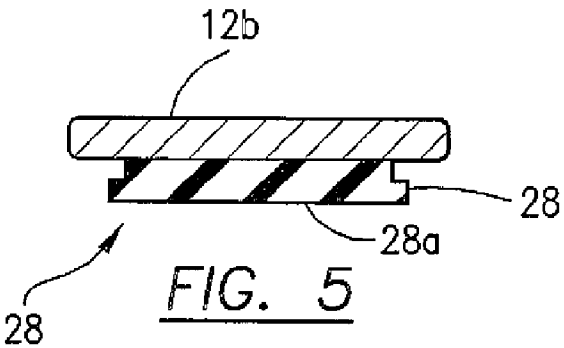
FIG. 5 shows a cross section view along line 5-5 of FIG. 4 of the top shoe in accordance with the present invention.

The top shoe 12 includes three flange interlock portions 26, 28, and 30. Multiple small flange interlock portions are preferable to one large flange interlock because the three separately provide greater flexibility (bend) within the sole of the top shoe 12. The upper portion of the flange interlock portions 26, 28, and 30 are permanently connected to the outsole 12*b* of the top shoe 12. The lower portion of the flange interlock portions 26, 28, and 30 extend downwardly so its lowest flat bottom is below the plane at the bottom of outsole 12*b* the top shoe 12. The bottom 4 of the outsole 12*b* of the top shoe 12 is shown in FIG. 4 and FIG. 5 as to portion 28. The bottom of the outsole 12*b* remains substantially flat notwithstanding the flange interlock portions 26, 28, 30. A flange interlock portion 28 cross-section is represented in FIG. 5. The peripheral flange 28*b* engages in the shoe base peripheral slot 24 to firmly lock the top shoe 12 to bottom shoe base 14 when the two are manually engaged. The interlock materials 28 and 24 are resilient and flexible enough to be manually engaged and manually separated. However the upper shoe 12 will not separate from show base 14 when engaged during normal use such as walking.

When the top shoe 12 is attached to the shoe base 14 to form a combined shoe, a friction type, mechanical fit between the flange interlock portions 26, 28, 30 and the inside recessed portion 24 (FIG. 3) results in a combined shoe. The nature of the mechanical fit can be seen through the interlock relationship of the recess 24 and the flange 28*b* structures. The forcible engagement of the recess 24 and the flange 28*b* results in a snug, mechanical fit. Thus, the mechanical fit resulting from the engagement of the flange interlock portions 26, 28, 30 with the inside recessed portion 24 of the shoe base 14 provides for the secure attachment of the top shoe 12 to the shoe base 14 and ensures the structural stability of the combined shoes.

Figure 6:
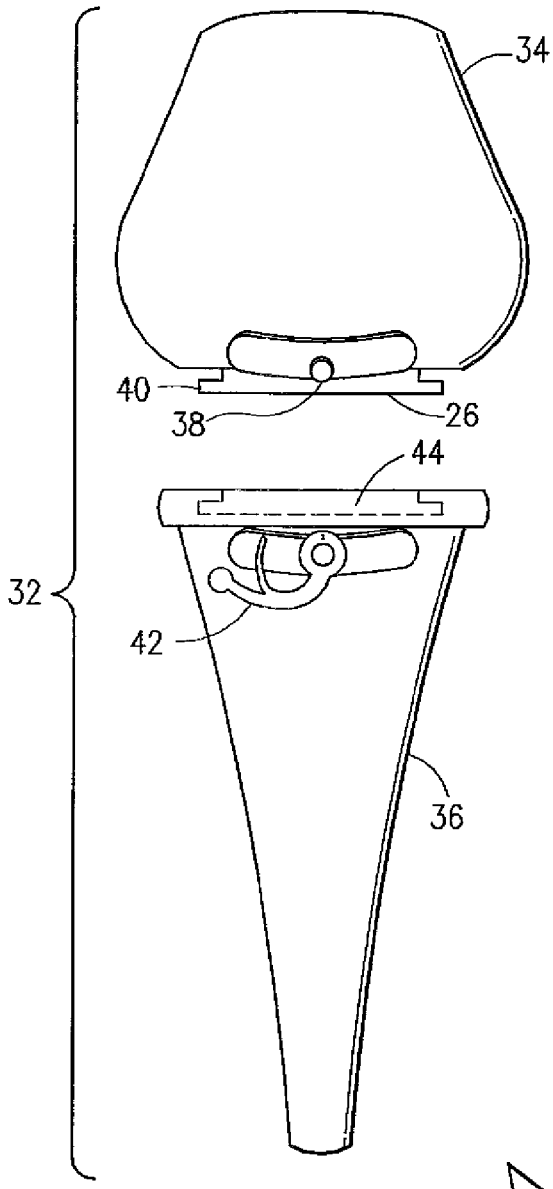
FIG. 6 is a rear elevational exploded view of a mechanical lock mechanism on the rear of a shoe system in accordance with the invention.
Figure 7:
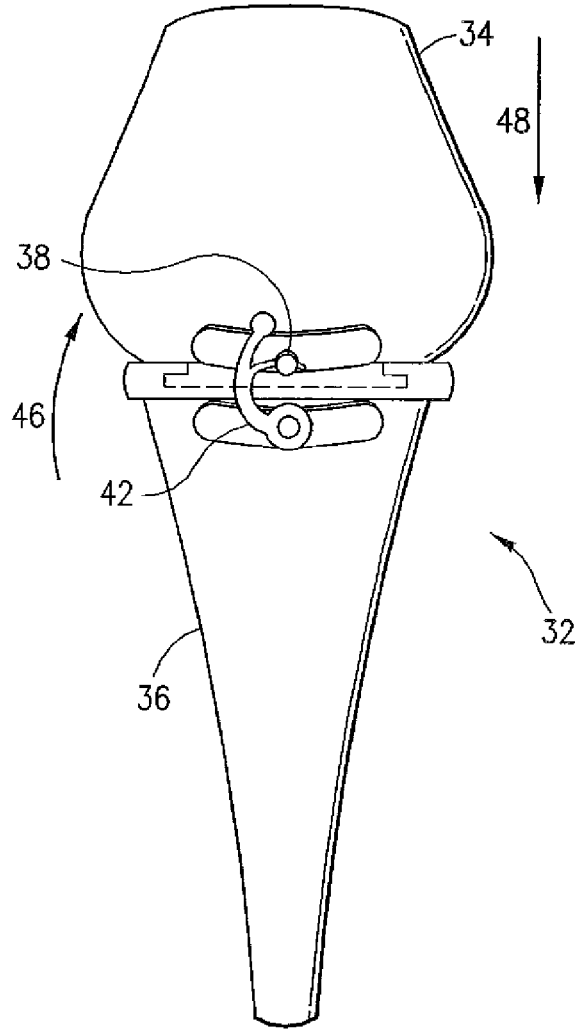
FIG. 7 is a rear elevational view of the mechanical lock mechanism on the rear of a shoe system in accordance with the invention.
Figure 8:
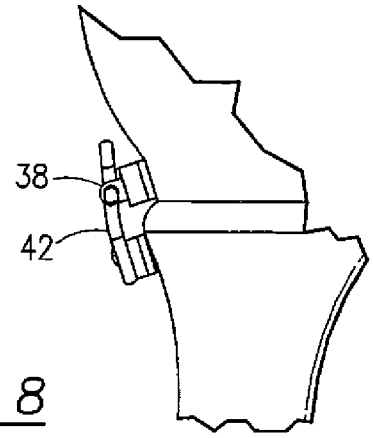
FIG. 8 is a side elevational view of mechanical lock mechanism on the rear of a shoe system in accordance with the invention.

Referring now to FIG. 6, FIG. 7, and FIG. 8, shoe system 32 is shown comprising a top shoe 34 that is separately wearable but can also be connected to a shoe base 36 shown in FIG. 7. The top shoe 34 contains a flange portion 40 which forms a mechanical lock with a recessed potion 44 of the shoe base 36. In addition, the top shoe 34 includes an "L" shape fastener rod 38, which is used to engage an "L" shape fastener 42 that is attached to the shoe base 36. The "L" shape fastener 42 is pivotally connected to the upper portion of the heel of the top shoe 36 and is rigid and "L" shaped so that it can engage fastener rod 38 on a top shoe 34.

When the top shoe is moved in a shoe engaging direction 48, the top shoe 34 becomes attached to the shoe base 36, primarily through the engagement of the flange portion 40 and the recessed potion 44. Then, the "L" shape fastener 42 is moved in a pivotally engaging direction 46 to engage the fastener rod 38 and lock the "L" shaped fastener 42 to the fastener rod 38, creating an even more firm fastening of the top shoe to the shoe base.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A customizable shoe system comprising:

a customizable shoe having an outsole and a shoe-upper permanently attached to said outsole, wherein said outsole has a bottom surface having at least two peripheral connection portions, wherein each said peripheral connection portion comprises a discrete protrusion at a distinct location on said outsole and has a flange interlock area about its perimeter, wherein each of said peripheral connection portions are sized sufficiently wide in relation to their location on the outsole that in combination, the peripheral connection portions are configured to form a substantially flat profile sufficient to provide a surface which is suitable to contact the ground and prevent the bottom surface from contacting the ground.

2. The customizable shoe system of claim 1, additionally comprising a shoe base having a base outsole and top side, wherein said shoe base has a fastening portion that is defined by an elevated rim extending around the perimeter of the top side, said rim having a flange recess about its interior surface above the top side; and wherein mechanically engaging said customizable shoe with said shoe base causes said flange interlock portions to clinch mechanically with said flange recess sufficient to cause said customizable shoe to be removably fastened to said shoe base.

3. The customizable shoe system of claim 2, wherein said elevated rim extends around the entire perimeter of the top side.

4. A customizable shoe system comprising:

a top shoe having an outsole and a shoe-upper, said outsole having a at least one peripheral connection portions, where said peripheral connection portions comprise a protrusion embedded on the outsole of the top shoe, where said protrusion includes a flange interlock portion;

a shoe base having an outsole and top portion, said shoe base having a fastening portion, where said fastening portion is defined by an elevated rim extending around the perimeter of the top portion, said rim having a flange recess about its interior surface above the top portion;

wherein at least one top exterior fasteners are attached to the shoe-upper of the top shoe section;

wherein one or more base exterior fasteners are attached to the external periphery of the shoe base; and wherein the top exterior fasteners correspond to the base exterior fasteners and the top shoe is mechanically locked to the shoe base by engaging the top exterior fasteners with the base exterior fasteners.

* * * * *